US011113921B2

(12) United States Patent
Metzger

(10) Patent No.: US 11,113,921 B2
(45) Date of Patent: Sep. 7, 2021

(54) ICE VENDING MACHINE AND RELATED METHODS

(71) Applicant: Mark Metzger, Phoenix, AZ (US)

(72) Inventor: Mark Metzger, Phoenix, AZ (US)

(73) Assignee: Quick & Pure Holding, LLC, Milwaukee, WI (US)

( * ) Notice: Subject to any disclaimer, the term of this patent is extended or adjusted under 35 U.S.C. 154(b) by 180 days.

(21) Appl. No.: 16/432,531

(22) Filed: Jun. 5, 2019

(65) Prior Publication Data

US 2021/0217267 A1 Jul. 15, 2021

Related U.S. Application Data

(60) Provisional application No. 62/681,328, filed on Jun. 6, 2018.

(51) Int. Cl.
*G07F 17/00* (2006.01)
*F25C 5/20* (2018.01)

(52) U.S. Cl.
CPC ..... *G07F 17/0071* (2013.01); *F25C 5/20* (2018.01); *F25C 2600/04* (2013.01)

(58) Field of Classification Search
CPC ..... G01F 17/0071; F25C 5/20–5/24; B65B 7/164; G07F 17/0071
See application file for complete search history.

(56) References Cited

U.S. PATENT DOCUMENTS 3,151,668 A 10/1964 Zimmermann
3,789,570 A 2/1974 Mullins, Jr.
4,689,937 A 9/1987 Finan, Sr. et al.
6,474,048 B1 11/2002 Metzger et al.
7,062,892 B2 6/2006 Metzger
7,207,156 B2 4/2007 Metzger
7,426,812 B2 9/2008 Metzger
7,681,408 B2 3/2010 Hobson et al.
7,735,527 B2 * 6/2010 Dunn ..... F25C 5/00 141/82
7,849,660 B2 12/2010 Metzger
8,468,784 B2 6/2013 Metzger
(Continued)

FOREIGN PATENT DOCUMENTS

CN 107512426 A 12/2017

OTHER PUBLICATIONS

English Language Translation of CN107512426 (Year: 2017).*
(Continued)

*Primary Examiner* — Cassey D Bauer
(74) *Attorney, Agent, or Firm* — Boyle Fredrickson, S.C.

(57) ABSTRACT

Implementations of ice vending machines may include a cabinet having a frame, an ice maker coupled to the frame, and an ice storage section coupled to the frame and below the ice maker. The ice storage section may include one or more agitators. Implementations may also include an ice feed coupled below the ice storage section, a bagging system coupled to the frame and below the ice feed, a retrieval section coupled to the frame and below the bagging system, and an interactive panel coupled to an outer surface of the cabinet. The interactive panel may be configured to receive a purchase request from a customer for a bag of ice. The ice vending machine, in response to the purchase request, may be configured to fill and dispense the bag of ice on demand.

12 Claims, 9 Drawing Sheets

(56) References Cited

U.S. PATENT DOCUMENTS

| | | | |
|---|---|---|---|
| 8,484,935 | B2 | 7/2013 | LeBlanc et al. |
| 8,511,101 | B1 | 8/2013 | Seymour |
| 8,763,352 | B2 | 7/2014 | Metzger |
| 10,240,844 | B1 | 3/2019 | Metzger et al. |
| 2004/0084106 | A1 | 5/2004 | James |
| 2004/0216481 | A1 | 11/2004 | James et al. |
| 2007/0175235 | A1 | 8/2007 | Metzger |
| 2007/0240441 | A1 | 10/2007 | Hobson et al. |
| 2012/0186202 | A1 | 7/2012 | Pandurangan et al. |
| 2012/0186276 | A1* | 7/2012 | Seymour ..... G07F 17/0071 62/66 |
| 2019/0043677 | A1* | 2/2019 | Gasperi ..... H02P 1/26 |

OTHER PUBLICATIONS

International Search Report, PCT Patent Application No. PCT/US2019/035644, dated Aug. 23, 2019, 2 pages.

Kooler Ice, IM1000 Ice Vending Machine, Retrieved from the Internet: http://www.koolerice.com/im1000-ice-vending-machine/ [retrieved May 30, 2019], 2019, 5 pages.

Kooler Ice, IM1000-Series II Ice and Water Vending Machine, Retrieved from the Internet: http://nebula.wsimg.com/a76571ea99828fb5ec7554771a185264?AccessKeyId=E1C788E3CB6FA3096305&disposition=0&alloworigin=1 [retrieved May 30, 2019], 2011, 4 pages.

* cited by examiner

ICE VENDING MACHINE AND RELATED METHODS

CROSS REFERENCE TO RELATED APPLICATIONS

This document claims the benefit of the filing date of U.S. Provisional Patent Application 62/681,328, entitled "Ice vending machines and Related Methods" to Metzger which was filed on Jun. 6, 2018, the disclosure of which is hereby incorporated entirely herein by reference.

BACKGROUND

1. Technical Field

Aspects of this document relate generally to ice vending machines.

2. Background

Ice vending machines dispense ice into bags to be purchased by a consumer. Ice vending machines may include a cooler where the bags of ice are stacked and stored. Ice vending machines may be stored indoors or outdoors.

SUMMARY

Implementations of ice vending machines may include a cabinet having a frame, an ice maker coupled to the frame, and an ice storage section coupled to the frame and below the ice maker. The ice storage section may include one or more agitators. Implementations may also include an ice feed coupled below the ice storage section, a bagging system coupled to the frame and below the ice feed, a retrieval section coupled to the frame and below the bagging system, and an interactive panel coupled to an outer surface of the cabinet. The interactive panel may be configured to receive a purchase request from a customer for a bag of ice. The ice vending machine, in response to the purchase request, may be configured to fill and dispense the bag of ice on demand.

Implementations of ice vending machines may include one, all, or any of the following:

The frame may be slidably coupled within the cabinet.

The cabinet may be insulated.

The ice storage section and the bagging system may be in a refrigerated area of the cabinet.

The ice vending machine may include a second and a third agitator.

the ice vending machine may be configured to fill and dispense a bag of ice within 15 seconds of receiving the purchase request.

The ice storage section may be configured to hold up to 1000 pounds of ice.

The ice vending machine may include a controller slidably coupled to the frame.

Implementations of ice vending machines may include a cabinet having a frame, an ice maker coupled to the frame, and an ice storage section coupled to the frame and below the ice maker. The ice storage section may include one or more agitators. Implementations may also include an ice feed auger coupled below the ice storage section and a bagging system coupled to the frame. The bagging system may include a blower and a heat sealer. Implementations may also include, a retrieval section coupled to the frame and below the bagging system, an interactive panel coupled to an outer surface of the cabinet, and a controller coupled to the frame. The interactive panel may be configured to receive a purchase request from a customer for a bag of ice, and in response to the purchase request, transmit a purchase signal to the controller. The controller, in response to the purchase request, may be configured to activate the blower to open a bag, active the ice feed auger to fill the bag with ice, and activate the heat sealer to seal the bag. The bag of ice may be filled and dispensed on demand.

Implementations of ice vending machines may include one, all, or any of the following:

The frame may be slidably coupled within the cabinet.

The ice storage section may be insulated.

The ice storage section and the bagging system may be in a refrigerated area of the cabinet.

The ice vending machine may be configured to fill a ten pound bag of ice and a less than ten pound bag of ice.

The heat sealer may include a rotating arm configured to open and close the heat sealer.

The heat sealer may include an identification code in a heat sealing element.

The ice vending machine may be configured to fill and dispense a bag of ice within 15 seconds of receiving the purchase request.

Implementations of a method for filling and dispensing a bag of ice may include making ice with an ice maker included within an ice vending machine, delivering the ice into an ice storage section coupled below the ice maker, and receiving an on demand purchase request from a customer for a bag of ice, the purchase request received through an interactive panel coupled to an outer surface of the ice vending machine. Implementations may also include transmitting a purchase signal to a controller from the interactive panel. The controller may be coupled within the ice vending machine. Implementations may also include, in response to the purchase signal, opening a bag using a blower coupled within the ice vending machine until a bag open sensor is triggered, in response the purchase signal, filling the bag with the ice through an ice feed auger coupled to the ice storage section until a bag full sensor is triggered, in response to the purchase signal, sealing the bag with a heat sealer, and dispensing the bag into a retrieval section included within the ice vending machine. The bag filled with ice may be dispensed within 30 seconds of receiving the purchase request.

Implementations of methods for filling and dispensing a bag of ice may include one, all, or any of the following:

The bag may include a handle on a first end of the bag opposite a second end of the bag configured to be heat sealed.

Implementations may include encoding each sealed bag using the heat sealer.

Implementations may include intermittently agitating the ice within the ice storage section.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended ice vending machine will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such ice vending machines, and implementing components and methods, consistent with the intended operation and methods.

Figure 1:
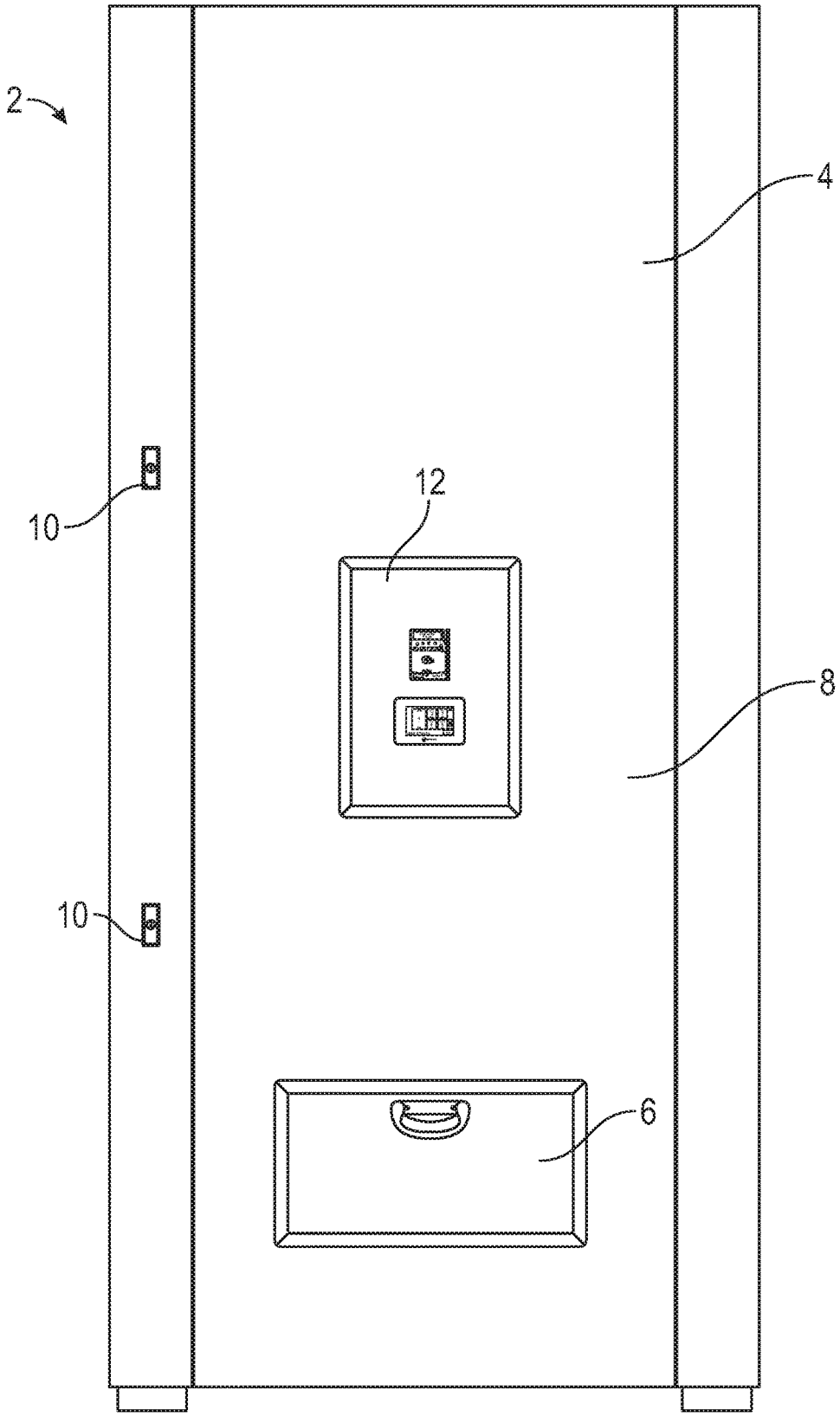
FIG. 1 is a front view of an ice vending machine.

Referring to FIG. 1, a front view of an ice vending machine is illustrated. Implementations of the ice vending machine 2 disclosed herein may be on demand ice vending machines, meaning that the ice vending machine may fill and dispense a bag of ice only right after it is requested or purchased. Accordingly, in various implementations the ice vending machine 2 may require that a single bag of ice be filled, dispensed, and retrieved by a customer before filling and dispensing another bag. In other implementations, a customer may order multiple bags and the ice vending machine may fill and dispense all of the bags for a customer to retrieve the bags. In various implementations, the on demand ice vending machine may take as little as 15 seconds to bag and dispense a bag of ice from the time a customer makes a purchase request. Other implementations may take even less time than this, including between 10-15 seconds or less than 10 seconds to bag and dispense a bag of ice. Other implementations may take less than 30 seconds to bag and dispense the bag of ice, and still other implementations may take 30 or more seconds to bag and dispense a bag of ice. In such implementations, because the ice vending machine operates on demand, it may eliminate the risk of theft as there is not a cooler full of loose bags of ice that can be stolen. Further, the on demand bagging system may be able to operate without an attendant. Because it is on demand, payment may be received by the system and the system may operate 24/7 without the need for an attendant. As illustrated by FIG. 1, the ice vending machine 2 may be sealed from the outside environment. The ice vending machine includes a cabinet 4 encasing the vending machine. In various implementations, the cabinet 4 may include aluminum, steel, any other type of metal, plastic, insulative materials, or any combination thereof. In various implementations, the cabinet may be weather tight and insulated. In various implementations, the entire cabinet may be insulated, while in other implementations, only the portions of the cabinet 4 enclosing the refrigerated areas may be insulated. In other implementations, the cabinet is not insulated but only internal elements (such as the ice storage section) are insulated. As illustrated by FIG. 1, the ice vending machine 2 may include an ice retrieval door 6. In such implementations, the ice retrieval door 6 to retrieve the ice may be sealed/closed except when a customer is retrieving a bag of ice. In implementations having a sealed ice vending machine, the risk of contaminants, such as dirt, dust, insects, debris, etc., may be substantially/essentially eliminated resulting in a guarantee of more pure ice. Further, because it is sealed, and because there is not a cooler of stored ice bags that need to be kept at a certain temperature, the ice vending machine may be kept outside, even in hot temperatures.

As illustrated by FIG. 1, the cabinet 4 may include a front door 8. In various implementations, the front door 8 may cover the entire front of or substantially the entire front of the ice vending machine 2. In such implementations, the front door may grant access to the ice retrieval section, the bagging system, the ice storage section, and/or the ice maker. In other implementations, the ice vending machine may include individual doors for each of these sections or any combination of these sections. In a particular implementation, the ice vending machine may include a door granting access to an upper section housing an ice maker of the ice vending machine and a lower door granting access to the remainder of the ice vending machine. While the door of FIG. 1 is illustrated as being the front of the ice vending machine (or the side of the ice vending machine having the interactive panel 12), in other implementations the door (or any door granting internal access to the ice vending machine) may be located on a side of the ice vending machine adjacent to or opposite the front of the device. As illustrated by FIG. 1, the door may include one or more locks 10. In various implementations, the locks may keep the ice vending machine closed except when the ice maker or other elements of the ice vending machine are to be serviced.

Figure 2:
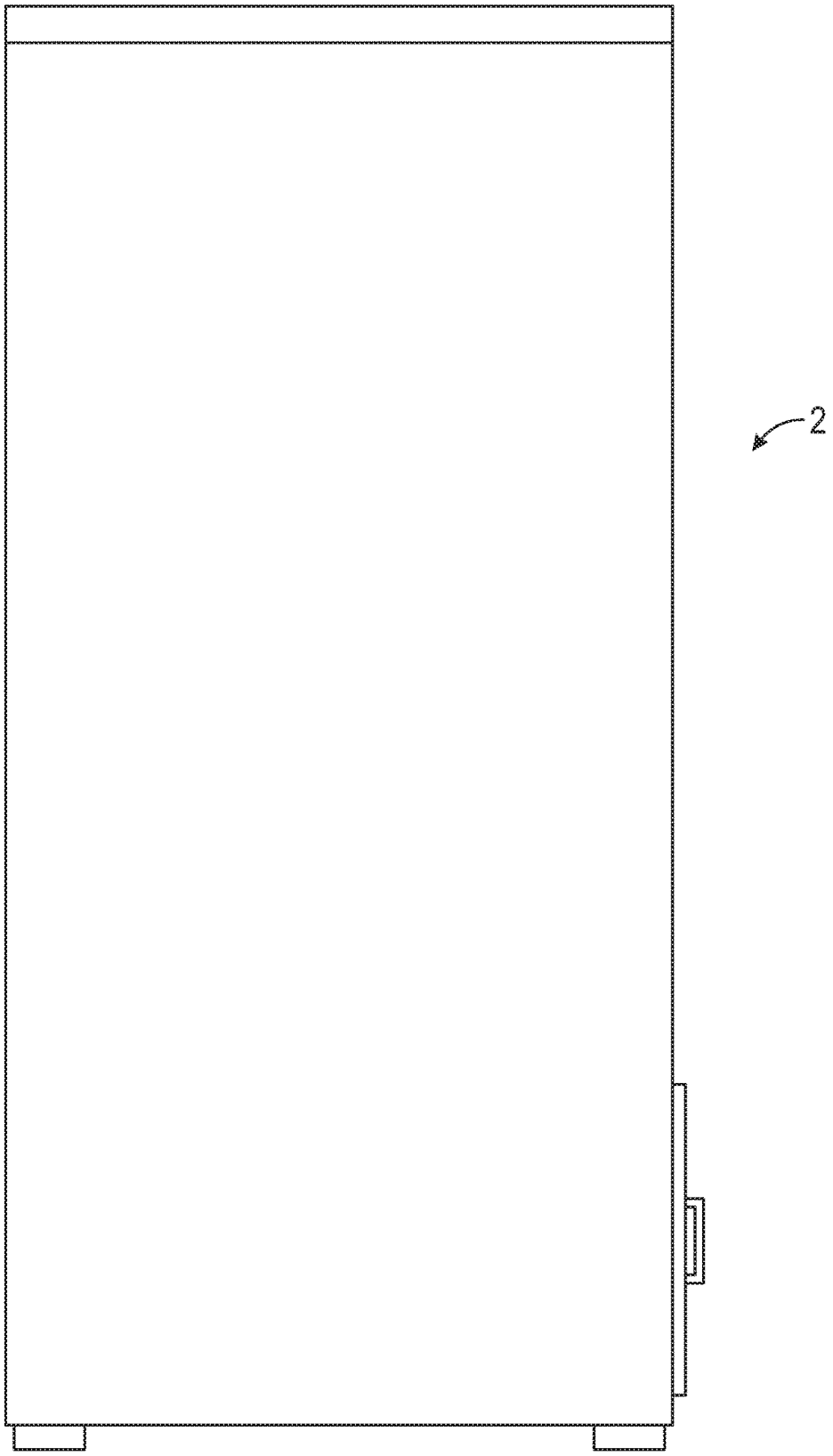
FIG. 2 is a side view of the ice vending machine.

The ice vending machine may be of various sizes and dimensions. In particular implementations, the ice vending machine 2 may be substantially 52 inches wide, 41 inches deep, and 102 inches tall. In other implementations, the ice vending machine may be substantially 52 inches wide, 55 inches deep, and 108 inches tall. In various implementations, the ice vending machine may be able to generate 250 ten pound bags of ice per day. In other implementations, the ice vending machine may be more or less wide, more or less deep, and more or less tall than the particular implementations disclosed herein. Referring to FIG. 2, a side view of the ice vending machine of FIG. 1 is illustrated. FIG. 2 illustrates the depth of the ice vending machine 2 while FIG. 1 illustrates the width of the ice vending machine 2.

Figure 3:
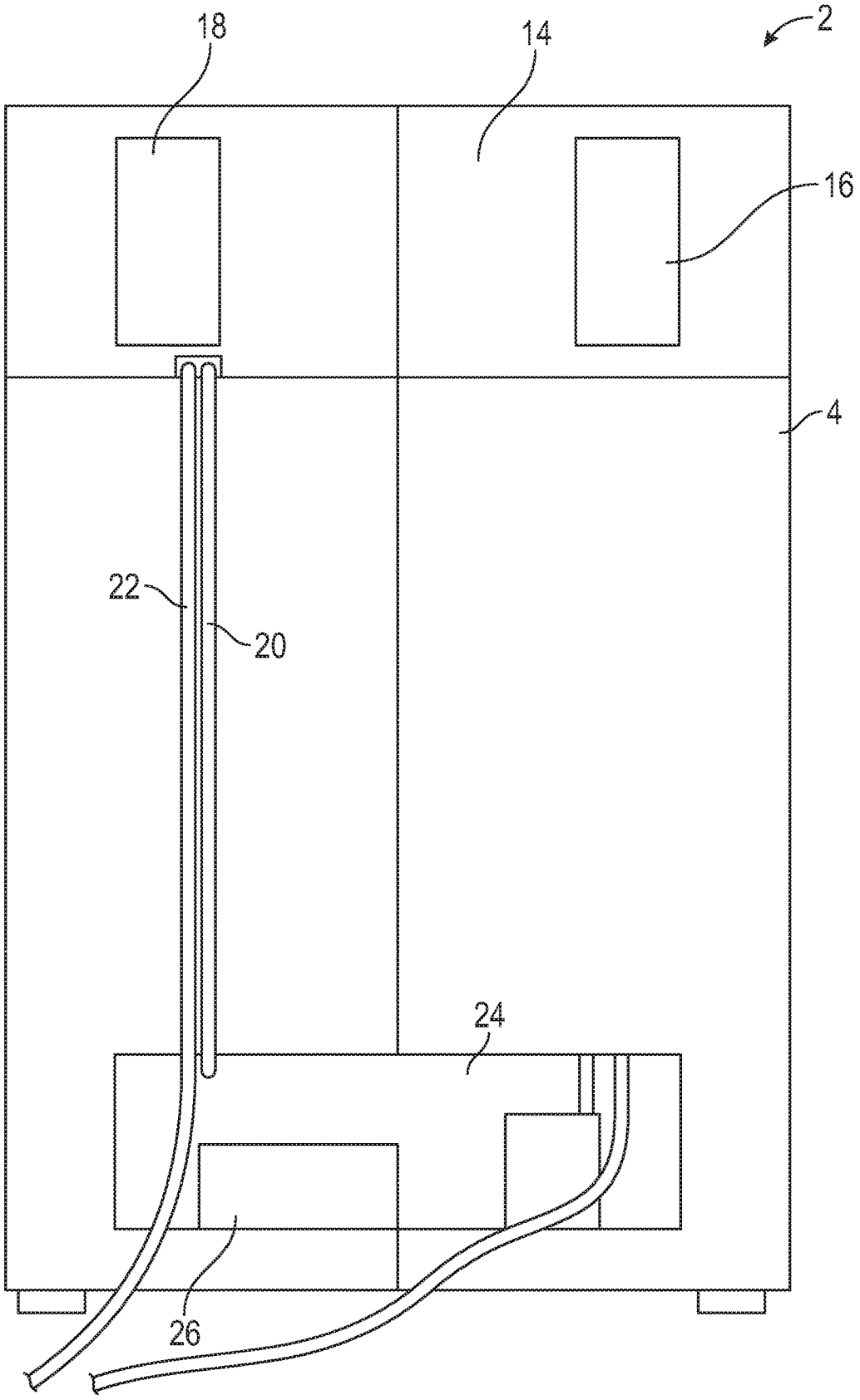
FIG. 3 is a rear view of the ice vending machine.

Referring to FIG. 3, a rear view of the ice vending machine is illustrated. In various implementations, the cabinet 4 may include an ice maker section 14 near the upper portion of the ice vending machine 2. As used herein, upper, and similarly over and under, are understood according to the orientation of FIG. 1. In various implementations, the ice maker section 14 may be configured to house an ice maker and may include an opening 16 for air intake for the ice maker and an opening 18 for exhaust from the ice maker. As illustrated by FIG. 3, the ice vending machine may include a water line 20 as well as a drain line 22 configured to couple to the ice maker. In various implementations, the ice vending machine 2 may include an open portion 24 configured to hold particular elements of the ice vending machine, such as, a compressor 26 used to cool the ice vending machine.

Figure 4:
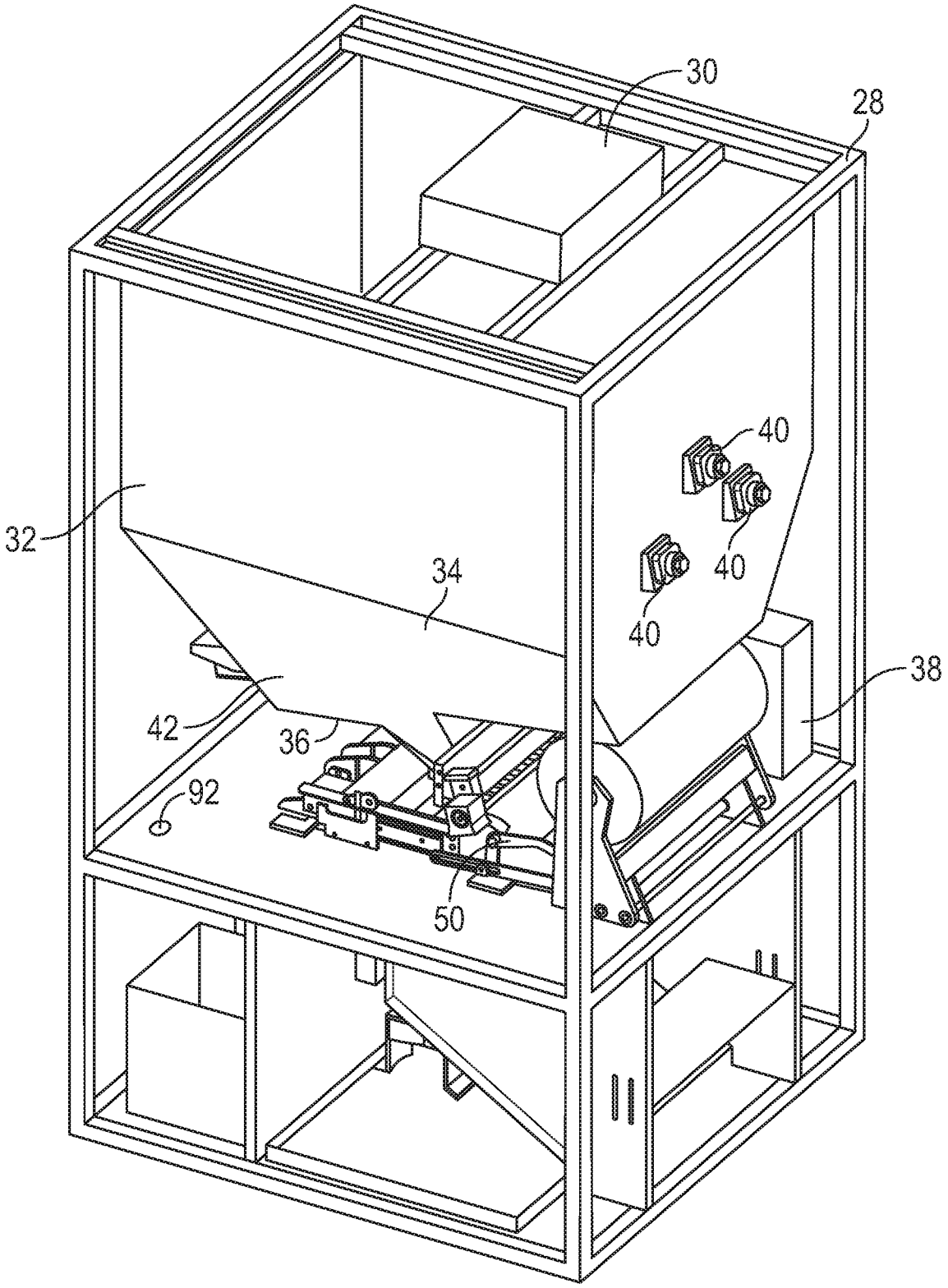
FIG. 4 is an internal perspective view of the ice vending machine.

Referring to FIG. 4, an internal perspective view (without the cabinet) of the ice vending machine is illustrated. In various implementations, the ice vending machine and the cabinet include a frame 28. The frame may be made from aluminum, steel (which may be stainless steel), or any other material disclosed herein. In various implementations, the frame may be slidably coupled to the cabinet. In such implementations, the frame may include a plurality of rollers coupled thereto allowing the frame to slide from the cabinet. In other implementations, the frame may include a plurality of tracks configured to slide along a plurality of rollers. In still other implementations, other mechanisms may be used to allow the frame to slide from the cabinet. In such implementations, when the cabinet door is open, the frame may be pulled out from the cabinet. In various implementations, any of the ice storage section 32, the ice feed 42, the bagging system 50, the retrieval section 68, and any combination may be fixedly coupled to the frame meaning that the frame may not move relative to these elements. In such implementations, service of the various elements of the ice vending machine may be facilitated as the frame and the various elements may be slid out from the cabinet and may be easily accessed. As illustrated by FIG. 4, the ice vending machine may include an ice maker 30 coupled to the frame. In various implementations, the ice maker is directly coupled to the frame, as illustrated by FIG. 4. In other implementations, the ice maker 30 may be indirectly coupled to the frame 28. In various implementations, the ice maker 30 may be fixedly coupled to the frame 28 meaning that it does not move relative to the frame. In other implementations, the frame 28 may be configured to slidably move relative to the ice maker 30. The ice maker 30 may be any of many types of ice makers, including any type of ice maker disclosed in the provisional application of paragraph [0001] or publications listed therein, all of which were previously incorporated herein by reference. The ice maker 30 may be configured to make cubed ice, crushed ice, or any other form or shape of ice. In various implementations, the ice maker 30 may be capable of making 2500 pounds of ice in a 24 hour period (or 250 ten pound bags worth of ice). In other implementations, the ice maker 30 may be configured to make more or less than 2500 pounds of ice in a 24 hour period.

Figure 7:
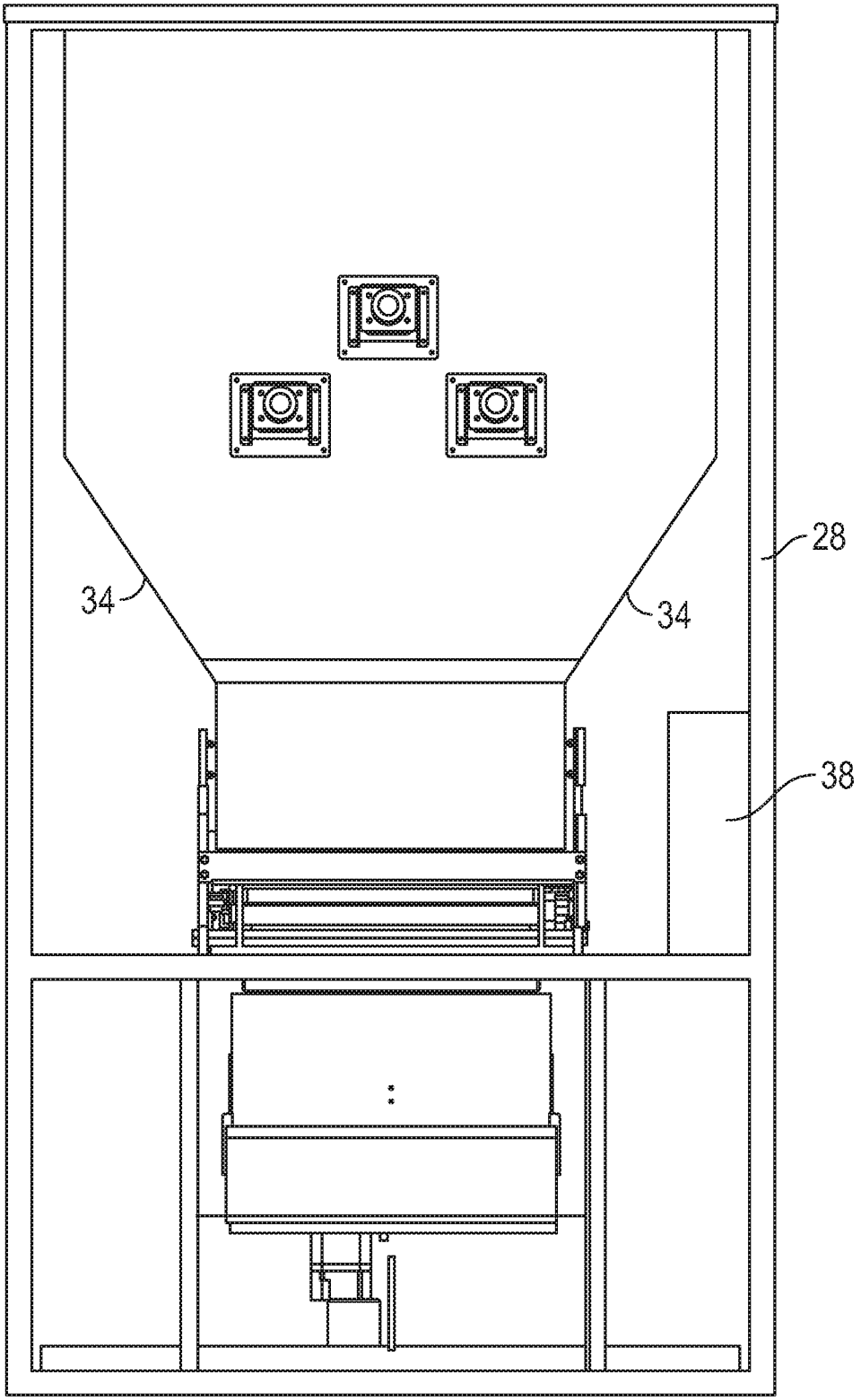
FIG. 7 is a front view of the internal elements of the ice vending machine.
Figure 8:
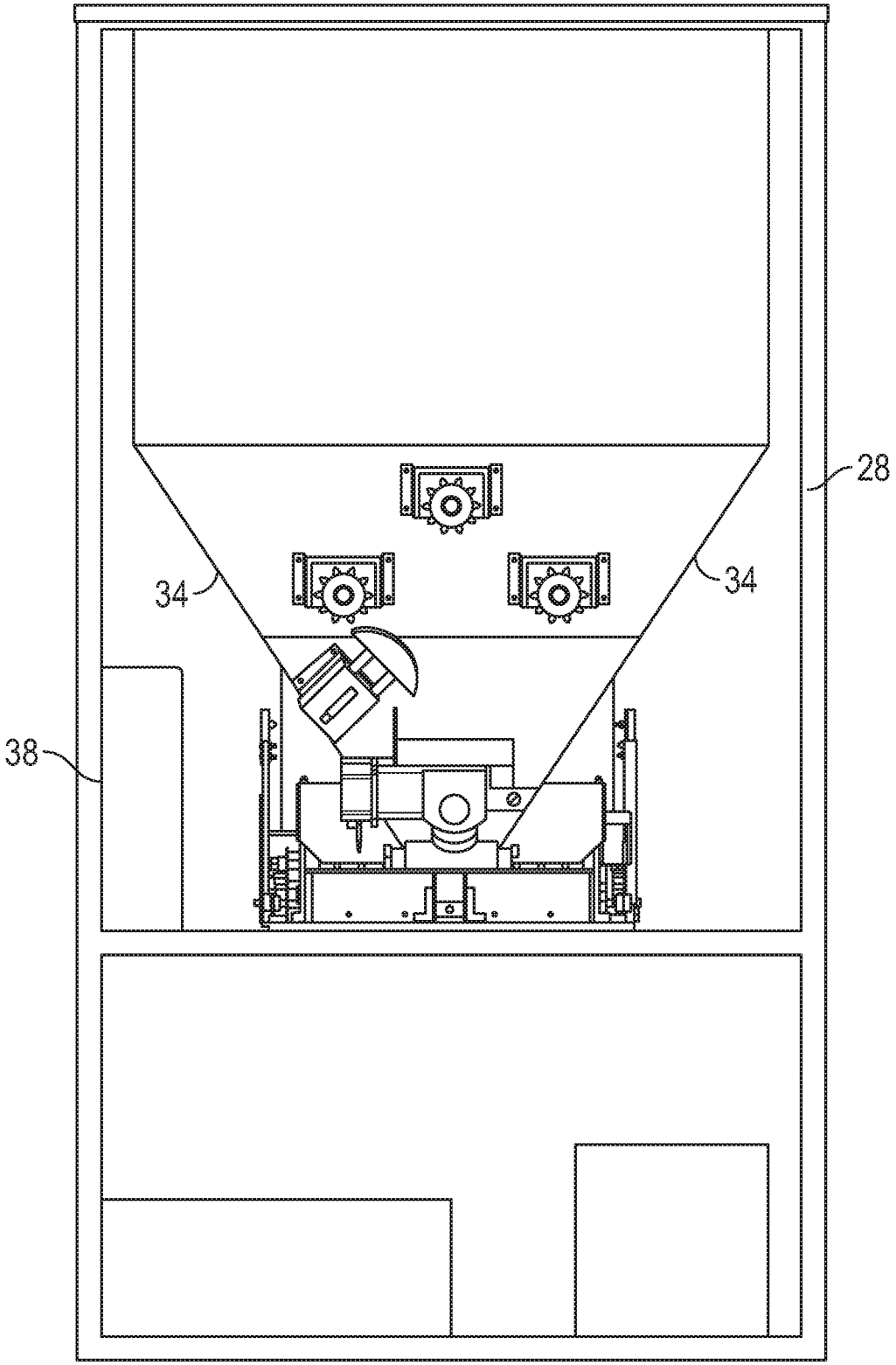
FIG. 8 is a rear view of the internal elements of the ice vending machine.

The ice vending machine includes an ice storage section 32. The ice storage section 32 is coupled to the frame 28 and may be positioned below the ice maker 30. In various implementations the ice storage section may be configured to hold up to 1000 pounds of ice. In various implementations, the ice storage section 32 may be configured to hold more or less ice than 1000 pounds of ice. As illustrated, the ice storage 32 section may have sidewalls which are oriented perpendicular to the floor of the ice vending machine. In other implementations, and as illustrated by FIG. 4, one or more of the sidewalls 34 or portions thereof may be sloped and the ice may be funneled towards the bottom of the ice storage section. This may be clearly illustrated by FIG. 7, which illustrates a front view of the internal elements of the ice vending machine and FIG. 8, which illustrates a rear view of the internal elements of the ice vending machine. Similarly, in various implementations, the ice storage section 32 may have a sloped base 36. The sloped base 36 may funnel the ice to the designated exit.

Figure 5:
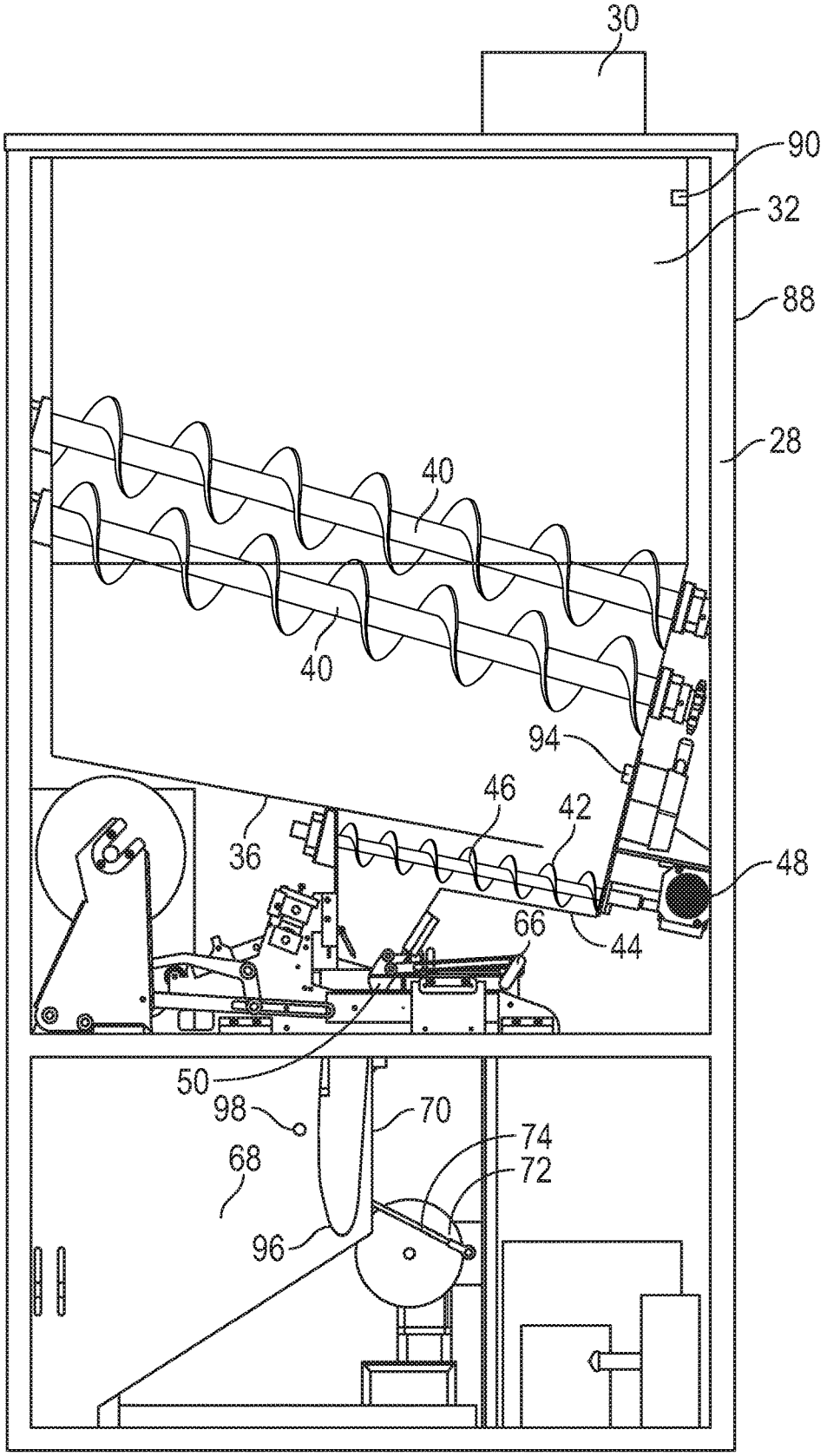
FIG. 5 is a partially transparent side view of the ice vending machine.

In various implementations, the ice storage section may be maintained at a temperature between 36 and 40 degrees Fahrenheit. In various implementations, the ice storage section may be the only portion of the ice vending machine that is refrigerated. In other implementations, the ice storage section may be one of a number of sections of the ice vending machine that is refrigerated. In various implementations, the ice storage section may be insulated. In such implementations, the insulation may reduce condensation as well as reduce the energy needed to run the ice vending machine. The ice storage section 32 may include a temperature sensor/thermometer which monitors the temperature. If the temperature in the ice storage section is to hot or cold, the temperature sensor may send a signal to a controller 38 which may in turn send a signal to a cooler to which may in turn adjust the ice storage section to the proper temperature. In various implementations, the signal, and any signal disclosed herein, may be sent wirelessly through a telecommunication channel or through a wired channel. The ice storage section 32 may also include an ice sensor 90 configured to detect the amount of ice in the ice storage section 32 (as illustrated by FIG. 5). In a particular implementation, the sensor 90 may be a retroreflective sensor, however, in other implementations other sensors may be used, such as a weight sensor. In various implementations, the sensor 90 may be located near the top of the ice storage section and when the ice storage section 32 is full, it may send a signal to the ice maker 30 to halt production of the ice. When the sensor 90 registers that the ice storage section 32 is no longer full, it may send a signal to the ice maker 30 to resume the production of the ice. Similarly, in other implementations, a weight sensor may be located near a bottom or mid-section of the ice storage section 32. When a predetermined weight is registered by the weight sensor, the sensor may send a signal to the ice maker 30 to halt the production of the ice. When the weight sensor indicates that the weight of the ice in the ice storage section is below a predetermined weight, it may send a signal to the ice maker 30 to resume the production of ice. Similarly, in various implementations the ice storage section 32 may include a low ice sensor 94 configured to detect low levels of ice. In various implementations, the low ice sensor 94 may be configured to trigger if there is insufficient ice in the ice storage section and may send a signal to the controller to prevent a customer making a purchase request for a bag of ice until the low ice sensor detects adequate levels of ice. In various implementations, the sensors may send a signal directly to the ice maker or may send the signal through the controller 38 to the ice maker 30.

Referring to FIG. 5, a partially transparent side view of the ice vending machine is illustrated. The ice storage section 32 may include one or more ice agitators 40. In various implementations, the agitators 40 may include augers while in other implementations, the agitators may not include augers. In the implementation illustrated by FIG. 5, the ice vending machine includes multiple augers spanning a width of the ice storage section 32. In particular implementations (and as illustrated by FIG. 4), the ice vending machine may include three agitators 40. Other implementations may include only a single agitator, two agitators, three agitators, or more than three agitators. In the implementation illustrated by FIG. 3, a single motor may be used to turn all three ice agitators 40. Alternatively, in other implementations each auger could be rotated through a separate motor. In various implementations, the rotation of each ice agitator 40 may be in synchronization with respect to one another, while in other implementations the ice agitators 40 may be configured to rotate out of synchronization with respect to one another. In particular implementations, the motor used to rotate the ice agitators 40 may include a ½ hp gear drive and may be configured to turn the agitators 40 for five seconds once every fifteen minutes. In other implementations, motors with more or less power may be configured to turn the agitators for more or less time and may be configured to turn the agitators more or less frequently.

Still referring to FIG. 5, the ice vending machine may include an ice feed 42. The ice feed 42 may be coupled below the ice storage section 32. In various implementations, the ice feed 42 may include an auger 46 angled upward and away from the portion of the ice feed that directly receives the ice from the ice storage section 32. Similarly, the floor 44 of the ice feed 42 may also be angled parallel to the length of the auger 46. The auger 46 of the ice feed 42 may be configured to turn in a direction which carries ice up the slope of the ice feed 42 to a point where the ice exits the ice feed 42. The auger 46 in the ice feed 42 may be powered by a motor 48. The motor may be configured to operate in only a single direction, while in other implementations the motor may be configured to rotate in a forward and reverse direction. In other implementations, rather than having an auger to move the ice into a bag, other mechanisms may be used, including, by non-limiting example, a shelf that tilts and dumps the ice into a bag, an arm that pushes the ice into a bag, a door that opens dropping a predetermined amount of ice into a bag, a belt that draws ice toward the bag, and any other mechanism that could be used to move ice.

Figure 6:
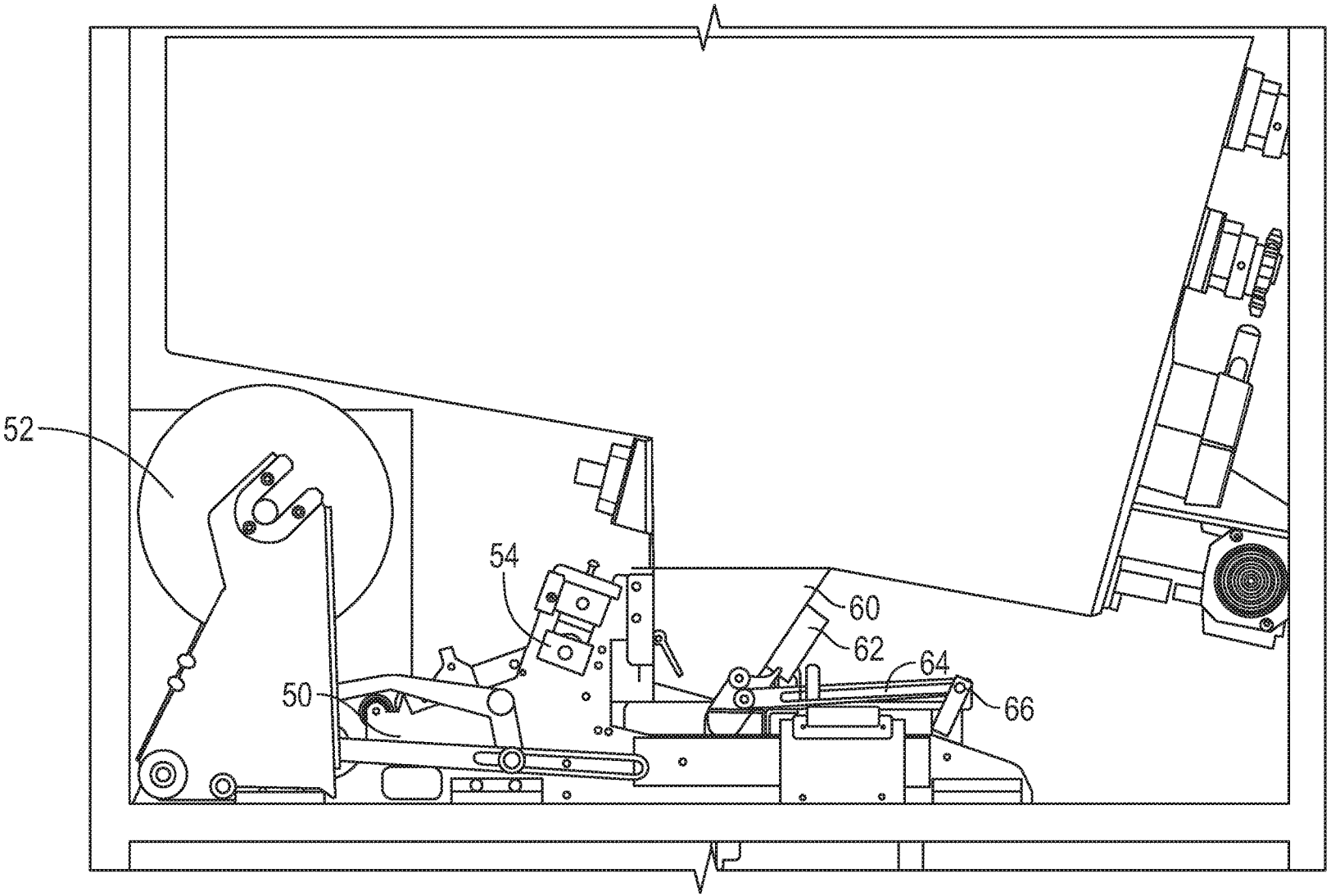
FIG. 6 is a magnified view of the bagging system of the ice vending machine.
Figure 9:
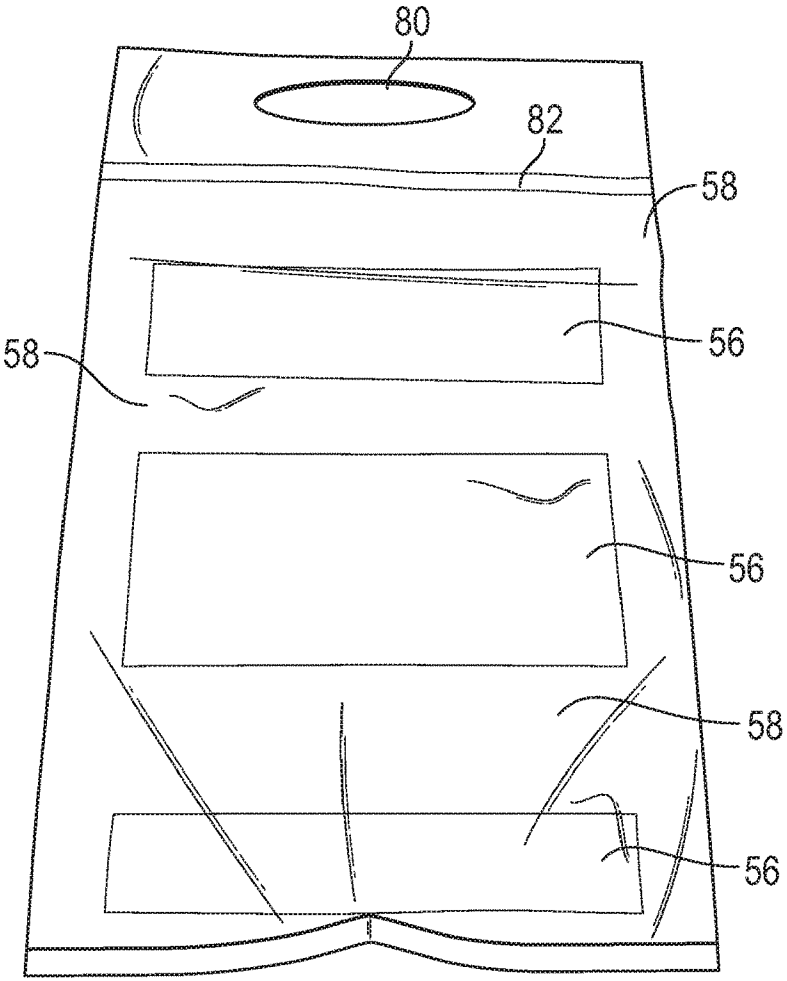
FIG. 9 is a view of a bag for the ice vending machine.

Still referring to FIG. 5, the ice vending machine includes a bagging system 50 coupled to the frame. The bagging system 50 may be coupled below the ice feed. The bagging system may be the same as or similar to any bagging system disclosed in the patents and patent application publications listed in the provisional application of paragraph [0001], all of which have previously been incorporated herein by reference. Referring to FIG. 6, a magnified view of the bagging system of the ice vending machine is illustrated. In various implementations, the bagging system may include a roll of bags 52, and in particular implementations, may include multiple rolls of bags. The roll of bags may be coupled to an arm that may or may not be rotatable. In implementations having multiple rolls of bags, each roll may include a different size of bag, such as 3 pound, 5 pound, 10 pound, 20 pound, or any other size of bag, allowing a single ice vending machine to provide a variety of different sizes of bags of ice. In implementations having only a single sized bag, the ice vending machine may still provide a variety of different sizes of bags of ice by only partially filling a bag. Such implementations may include 3 pounds of ice in a bag, 5 pounds of ice in a bag, 10 pounds of ice in a bag, 20 pounds of ice in a bag, or any other amount of ice in the bag. Accordingly, the ice vending machine may be configured to fill a ten pound bag of ice and a bag of ice having more than or less than 10 pounds. In such implementations, a single role and size of bags may be included in the bagging system 50 and the ice vending machine may still be able to fill bags with various amounts of ice. In particular implementations, the bags may be bags marketed under the tradename of SHARP® by Sharp Packaging Systems by Pregis, of Tempe Ariz. The bags may be pre-opened and on a continuous roll. The roll of bags may or may not include perforations. Referring to FIG. 9, a view of a bag is illustrated. In various implementations, each bag within the roll of bags may include a specific pattern of printed 56 and non-printed spaces 58 that span across the bag. Further, in various implementations each bag may include a handle 80. In various implementations, and as illustrated by FIG. 9, the handle may be located on the same end of the bag as the location 82 of the heat seal. In other implementations, the bag includes a handle on an end of the bag opposite the end of the bag having the location of the heat seal. In such implementations, the handle on the opposite side of the bag may facilitate a customer retrieving the bag from the ice vending machine inasmuch as the handle will then be on the side of the bag closest to the exit of the retrieval section.

Referring back to FIG. 6, in such implementations, the bagging system may include a sensor 54 which reads the pattern on each bag. The sensor may be, by non-limiting example, a laser sensor or a retroreflective sensor. The sensor may communicate with the bag feeder information such as when to stop feeding bags, based upon the sensor reading the pattern, or code, on the bag. The bag feeder may include a stepper motor with an encoder in order to feed the bags. The bagging system 50 may be configured to move each bag into a position below the ice feed in order for each bag to be filled with ice, and in implementations including a hopper 60, may be configured to feed each bag into a position below the hopper 60. In implementations having a hopper 60, the hopper may be configured to receive and funnel ice into a bag. The ice vending machine may include a blower 62 configured to blow open each bag prior to filling the bags with ice. As illustrated by FIG. 5, a bag 96 is blown open. In various implementations, the blower may blow open the bag until a bag open sensor 98 is triggered. The bag open sensor may be any type of sensor disclosed herein. The blower may the same as or similar to any blower disclosed in the provisional application of paragraph [0001]. The blower (and any other motorized component herein) may include a motor marketed under the tradename ORIENTAL MOTOR® by Oriental Motor Company of Tokyo Japan. Further, in various implementations, any motor disclosed herein may be an AC powered motor.

In various implementations, the bagging system 50 may include a heat sealer 64. The heat sealer may the same as or similar to any heat sealer disclosed or incorporated into the provisional patent application of paragraph [0001]. The heat sealer 64 may be configured to seal a filled bag of ice. The heat sealer 64 may include a motor and a linear actuator. In particular implementations, the linear actuator operates under a force of approximately 90 inch-pounds. In other implementations, the linear actuator may operate under more or less force. In still other implementations, and as illustrated by FIGS. 5-6, the heat sealer 64 may include a rotating arm 66 configured to close and/or open the heat sealer with the rotation of the arm 66. In various implementations, the heat sealer 64 may be pulsed. In particular implementations, the heat sealer 64 may seal each bag with 2-3 pulses. The pulses may be short, long, or a combination thereof. In particular implementations with three pulses, the heat sealer may seal each bag with two short pulses and one long pulse. In various implementations, the heat sealing element (or the element that makes direct contact with the bag) of the heat sealer 64 may include a system specific identification (ID) code thereon. In such implementations, each sealed bag of ice may in turn be marked with the system specific ID code thereon, corresponding to the specific ice vending machine. This may facilitate compliance with regulations requiring that the ice be marked with a source identifying indicator. In various implementations, the heat sealer 64 may also perforate and/or separate the filled bag from the remaining roll of bags. The heat sealer may include one or more sensors. In particular implementations, the heat sealer includes an open proximity sensor and a closed proximity sensor, however, in other implementations the heat sealer may include other sensors, including any type of sensor disclosed herein.

In various implementations, the ice storage section 32, the bagging system 50, or the ice storage section and the bagging area may be in a refrigerated area of the cabinet. In such implementations, the area may be configured to be cooled to between 36-40 degrees Fahrenheit. In such implementations, the area may include a temperature sensor 92 configured to monitor and maintain the temperature similar to any other temperature sensor disclosed herein, as illustrated by FIG. 4.

Referring back to FIG. 5, the ice vending machine may include a retrieval section 68 coupled to the frame. The retrieval section may be positioned below the bagging system. The retrieval section may be the area that the filled and sealed bag of ice is dispensed too. As illustrated by FIG. 1, the retrieval section 68 may include a door 6 allowing access thereto. In implementations having the door 6, the door may remain locked until a bag of ice is ready for retrieval. In particular implementations, the door 6 may include a low voltage magnetic lock. When the bag of ice is ready to be retrieved, the door may be unlocked for a period of time, after which the door will automatically lock again. In particular implementations, the door 6 may remain unlocked for fifteen seconds, however, in other implementations the door may remain unlocked for a shorter or a longer period of time. In other implementations, the door 6 may include a mechanical locking mechanism. The door 6 may include a plurality of sensors (which may be proximity sensors) which indicate whether the door is open or closed and in turn, whether the door should be locked or unlocked. The system may also include sensors to indicate when the door should be unlocked. In other implementations, the retrieval section may not include a door but may be open.

Referring back to FIG. 5, the retrieval section 68 may include a bag support shelf 70. In various implementations, the bag support shelf 70 may be lowered and raised using a solenoid. In various implementations, each bag of ice may be filled with the bag support shelf in a raised position. Upon the bag being filled, sealed, and/or separated from the roll of bags, the bag support shelf may be lowered. In particular implementations, when the bag support shelf lowers, the weight of the bag may separate the bag from the remainder of the roll of bags. In various implementations, the bag support shelf may extend at an angle perpendicular to the floor of the ice vending machine, while in other implementations the bag support shelf may extend to a sloped position. In still other implementations, each bag of ice may be filled with the bag support shelf 70 in a lowered position. Upon the bag being filled, sealed, and/or separated from the roll of bags, the bag support shelf may be partially raised, resulting in the bag support shelf 70 to slope towards the door of the retrieval section. In such implementations, the filled bag of ice may slide down towards the door, allowing for easier retrieval by a customer. As illustrated by FIG. 5, in particular implementations the ice vending machine may include a wheel 72 and a shaft 74 coupled to the bag support shelf 70. In such implementations, a motor may be configured to rotate the wheel 72 which in turn raises or lowers the bag support shelf 70 through movement of the shaft 74.

Figure 10:
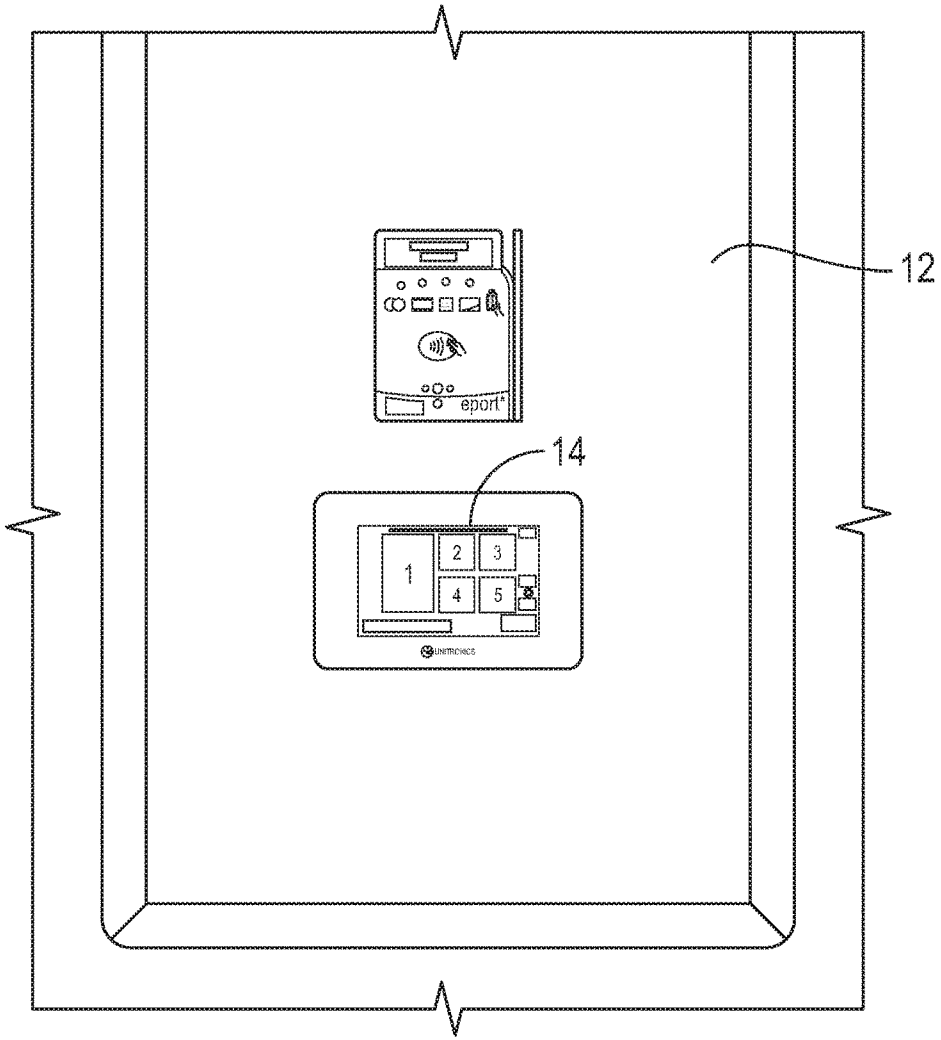
FIG. 10 is a view of the interactive panel of the ice vending machine.

Referring back to FIG. 1, the ice vending machine may include an interactive panel and/or screen 12 coupled to an outer surface of the cabinet 4. Referring to FIG. 10, a magnified view of the interactive panel is illustrated. In various implementations, the interactive panel 12 may include a touch screen 76 or traditional push buttons. In various implementations, a customer may be able to select how many bags of ice they wish to purchase, the type of ice (crushed, cubed), the size of bag etc. and submit the on demand purchase request to the ice vending machine for a bag of ice. The customer may also be able to pay using the interactive panel 12. In various implementations, the ice vending machine may be configured to receive cash, however, in other implementations the ice vending machine may include a cashless payment system 78, such as, by non-limiting example, a credit card reader, an e-port cashless system, or if located near a store, through a command from the store attendant (such as a push button) or through a token which can be purchased through the store. In various implementations, the cashless payment system may be configured to only take payments below a certain amount in order to not require additional verification. In such implementations, a customer may be required to make additional transactions if they desire an amount of ice that exceeds the certain amount.

Referring back to FIG. 4, in various implementations the ice vending machine may include a controller 38 coupled to the frame 28. In various implementations, the controller 38 may be coupled, wirelessly or through wires, to the interactive panel 12. In various implementations, the controller 38 may be slidably coupled to the frame 28. In such implementations, the controller 38 may be slid away from within the cabinet of the ice vending machine when the door to the front of the ice vending machine is opened and/or the controller is accessible. In such implementations, the controller 38 may be more easily serviced when it is slid away from the frame 28. The controller 38 may be configured to receive a purchase signal from the interactive panel and may then execute the purchase request through activating the ice vending machine to fill and dispense a bag of ice. More specifically, the controller, upon receiving the purchase signal, may be configured to activate the blower to open a bag, activate the ice feed auger to fill the bag with ice, and activate the heat sealer motor to seal the bag. Accordingly, the bag of ice may be filled and dispensed on demand by the ice vending machine as it is filled and dispensed in response to a purchase request from a customer.

In various implementations, the ice vending machine 2 and/or the controller 38 may be connected to the internet. In such implementations, the ice vending machine 2 may be part of a two-way cell communication between a remote supervisor and the ice vending machine 2. In such implementations, if there is an error in the system, it may immediately notify the supervisor who may address the error remotely, or if necessary, send a repairman to address the issue. In similar implementations, the two-way cell communication may also allow for audio to be transmitted between a customer and the ice vending machine's remote supervisor. In this manner, a single attendant or supervisor would be able to simultaneously monitor and attend multiple ice vending machines at varying and different locations, including ice vending machines all across one or more countries.

In various implementations where the interactive panel comprises a touch screen, the touch screen may be configured to play advertisements or display media to a customer while the ice machine is filling and dispensing the bag of ice. In other implementations, the ice vending machine may include a screen in addition to the touch screen of the interactive panel (or separate from the interactive panel altogether) used to play advertisements or media to a customer while the bag of ice is being filled and dispensed.

In various implementations, a method of producing a bag of ice for a customer may include putting the ice vending machine in a ready state. The system may move into the complete ready state upon a request from a customer. In other implementations, the system may always be in a partial ready state (such as having the ice maker on and delivering the ice into the ice storage section), and may move into the full ready state upon the ice vending machine receiving an on demand purchase request from a customer. In other implementations, before an on demand purchase request is able to be made the ice vending machine may be required to be in a full ready state. In various implementations, a full ready state may include ensuring that the ice maker is on, that ice is in the ice storage section, and a low ice sensor within the ice storage section is not triggered (in order to ensure that there is enough ice for at least one bag). In implementations including a retroreflective sensor, the sensor may be triggered when it is no longer blocked by the ice. The full ready state may include positioning a bag below the ice feed and opening the bag with the blower as previously disclosed herein. Sensors, including any type of sensor disclosed herein, may be used to ensure the bag is in the correct position and is open. The method may also include opening the heat sealer and ensuring that the heat sealer is in an open position. Sensors may ensure that the sealer is heated and open. The sensors may be any type of sensor disclosed herein. The bag support shelf may be moved to a proper position, and the door to the retrieval may be closed. Sensors, including proximity sensors, may be used to determine if the door is closed. In various implementations, the method for filling the bag of ice may include agitating ice within the ice storage section intermittently using one or more agitators. The agitators may be any type of agitator disclosed herein. In various implementations, upon the system being ready, the method for filling a bag of ice may include receiving an on demand purchase request from a customer through the interactive panel. The interactive panel may be any type of interactive panel disclosed herein. In various implementations, the on demand purchase request may only be made after payment is received. The method may include transmitting a purchase signal to the controller from the interactive panel in response to the on demand purchase request being made. The controller may be any type of controller disclosed herein. In various implementations, the method to fill the bag of ice may include, in response to the purchase signal, opening a bag using a blower coupled within the ice vending machine. In various implementations, the bag may be opened until a bag open sensor is triggered. In implementations including a retroreflective sensor, the bag open sensor may be triggered when the opened bag blocks the sensor. The bag open sensor may be any type of sensor disclosed herein. In various implementations, the method to fill the bag of ice may include, in response to the purchase signal, filling the bag with ice through the ice feed. The ice vending machine may include a sensor which senses whether or not the bag is full of ice. This bag full sensor may be a retroreflective sensor or a weight sensor which senses the weight of the bag of ice. The method of filling the bag with ice may include filling the bag until a sensor is triggered, upon which the sensor may send a signal to the ice feed (and may send the signal through the controller) to stop filling the bag with ice. Upon the system filling the bag, the system may dispense the bag. Such a method of dispensing the bag may include, in response to the purchase signal, sealing the bag with the heat sealer. The heat sealer may include any type of heat sealer disclosed herein. In particular implementations, the method may include encoding each sealed bag using the heat sealer. The method may include separating the filled bag of ice from the remainder of the roll of bags. In various implementations, upon heat sealing the bag, one or more bag feed rollers may reverse 1-2 inches in order to separate the filled bag from the unfilled bags. The method to dispense the bag may include lowering the bag support shelf and allowing the bag to be in a position where it can be retrieved. In various implementations, sensors may indicate when the bag is in such a position and they may send a signal to unlock the door to the retrieval section for a certain period of time in which the ice may be retrieved. Upon the bag being retrieved, the door may lock and the system may reenter into a complete or full ready state. The method of filling and dispensing the bag may be completed in any amount of time disclosed herein, including within 10-15 seconds, as measured from the time of receiving the purchase request.

In places where the description above refers to particular implementations of ice vending machines and implementing components, sub-components, methods and sub-methods, it should be readily apparent that a number of modifications may be made without departing from the spirit thereof and that these implementations, implementing components, sub-components, methods and sub-methods may be applied to other ice vending machines.

What is claimed is:

1. An ice vending machine comprising:

a cabinet comprising a frame, the frame slidably coupled within the cabinet;

an ice maker coupled to the frame;

an ice storage section coupled to the frame and below the ice maker, the ice storage section comprising one or more agitators;

an ice feed coupled below the ice storage section;

an ice auger extending through a longest length of the ice feed;

a bagging system coupled to the frame and below the ice feed;

a retrieval section coupled to the frame and below the bagging system; and an interactive panel coupled to an outer surface of the cabinet;

wherein an entrance to the ice feed from the ice storage section is configured to remain open;

wherein a portion of the ice feed extending away from the entrance to the ice feed is angled towards the ice maker;

wherein the interactive panel is configured to receive a purchase request from a customer for a bag of ice; and wherein the ice vending machine, in response to the purchase request, is configured to fill and dispense the bag of ice on demand.

2. The ice vending machine of claim 1, wherein the cabinet is insulated.

3. The ice vending machine of claim 1, wherein the ice storage section and the bagging system are in a refrigerated area of the cabinet.

4. The ice vending machine of claim 1, further comprising a second and a third agitator.

5. The ice vending machine of claim 1, wherein the ice storage section is configured to hold up to 1000 pounds of ice.

6. The ice vending machine of claim 1, further comprising a controller slidably coupled to the frame.

7. An ice vending machine comprising:

a cabinet comprising a frame, the frame slidably coupled within the cabinet;

an ice maker coupled to the frame;

an ice storage section coupled to the frame and below the ice maker, the ice storage section comprising one or more agitators;

an ice feed auger coupled below the ice storage section;

a bagging system coupled to the frame, the bagging system comprising a blower and a heat sealer;

a retrieval section coupled to the frame and below the bagging system;

an interactive panel coupled to an outer surface of the cabinet; and a controller coupled to the frame;

wherein the interactive panel is configured to receive a purchase request from a customer for a bag of ice and in response to the purchase request, transmit a purchase signal to the controller;

wherein the controller, in response to the purchase signal, is configured to activate the blower to open a bag, activate the ice feed auger to fill the bag with ice, and activate the heat sealer to seal the bag; and wherein the bag of ice is filled and dispensed on demand.

8. The ice vending machine of claim 7, wherein the ice storage section is insulated.

9. The ice vending machine of claim 8, wherein the ice storage section and the bagging system are in a refrigerated area of the cabinet.

10. The ice vending machine of claim 7, wherein the ice vending machine is configured to fill a ten pound bag of ice and a less than ten pound bag of ice.

11. The ice vending machine of claim 7, wherein the heat sealer comprises a rotating arm configured to open and close the heat sealer.

12. The ice vending machine of claim 7, wherein the heat sealer comprises an identification code in a heat sealing element.

* * * * *